United States Patent [19]

Kuznetsov et al.

[11] Patent Number: 4,558,737

[45] Date of Patent: Dec. 17, 1985

[54] DOWNHOLE THERMOACOUSTIC DEVICE

[76] Inventors: Oleg L. Kuznetsov, Leninsky prospekt, 69, korpus 3, kv. 379; Rafkhat A. Maxutov, Leninsky prospekt, 67, kv. 164; Vladimir O. Malchenok, Teply Stan, 2-y mikroraion, 29, kv. 39; Khanuko M. Mordukhaev, ulitsa Millionschikova, 15, kv. 13; Anatoly P. Ostrovsky, Lomonosovsky prospekt, 14, kv. 312; Adolf E. Rubtsov, ulitsa Yartsevskaya, 27, korpus 5, kv. 30; Ernst M. Simkin, ulitsa Novoalexeevskaya, 1, kv. 16; Alexei V. Sokolov, prospekt Mira, 112, kv. 255, all of Moscow, U.S.S.R.

[21] Appl. No.: 332,160

[22] Filed: Dec. 18, 1981

[51] Int. Cl.[4] ..... E21B 36/04

[52] U.S. Cl. ..... 166/60; 166/177; 166/65.1

[58] Field of Search ..... 166/60, 65 R, 104, 177, 166/249, 248; 367/157, 159

[56] References Cited

U.S. PATENT DOCUMENTS

| | | | |
|---|---|---|---|
| 3,322,196 | 5/1967 | Bodine, Jr. | 166/249 |
| 3,449,712 | 6/1969 | Angeloff | 367/157 |
| 3,578,081 | 5/1971 | Bodine | 166/249 |
| 3,583,677 | 6/1971 | Phillips | 166/177 X |
| 3,848,671 | 11/1974 | Kern | 166/248 |
| 4,437,518 | 3/1984 | Williams | 166/60 X |

FOREIGN PATENT DOCUMENTS

| | | | |
|---|---|---|---|
| 832072 | 5/1981 | U.S.S.R. . | |
| 862392 | 9/1981 | U.S.S.R. | 367/157 |

OTHER PUBLICATIONS

Simkin, E. M., "Investigation of Heat Action on Hole--Bottom Zone of Wells by Deep-Hole Electric Heaters", All-Union Oil and Gas Research Institute of the Ministry of Oil Industry of the U.S.S.R., pp. 122-123, 1968.

*Primary Examiner*—James A. Leppink
*Assistant Examiner*—Bruce M. Kisliuk
*Attorney, Agent, or Firm*—Lilling & Greenspan

[57] ABSTRACT

A downhole thermoacoustic device comprises a heater with a terminal chamber, connected to a source or radiator of acoustic oscillation, including a hollow housing having mounted therein a longitudinal shaft carrying coils with cores in the form of a plurality of flat rings of a magnetostrictive material, operable as the active elements adapted to generate acoustic oscillation. Accommodated intermediate the coils is a member for focusing the acoustic field, in the form of a sleeve, while the longitudinal shaft carries a tube-shaped reflector of acoustic oscillation internally of the core of each coil. The top and bottom portions of the hollow housing of the radiator of acoustic oscillation have mounted therein damping elements including sleeves of a resilient material, while a heat-insulating member including a sleeve with a fluted surface is provided intermediate the terminal chamber of the heater and the hollow housing of the radiator.

37 Claims, 2 Drawing Figures

DOWNHOLE THERMOACOUSTIC DEVICE

BACKGROUND OF THE INVENTION

1. Field of the Invention

The invention relates to well-drilling techniques, and more particularly it relates to downhole thermoacoustic devices.

The invention is intended for utilization in the oil and gas industry, for exerting thermoacoustic action upon the hole-bottom zone of oil and gas wells so as to intensify the rate of development and production in fields with viscous paraffin-containing oils, as well as in fields containing considerable quantities of dissolved salts tending to leave deposits affecting the oil and gas permeability of the hole-bottom area of a well in the course of developing the latter.

2. Description of the Prior Art

The application of the method of thermoacoustic action upon the hole-bottom zone of wells is based on the phenomena of thermodynamic interaction of heat and sound fields in crude oil and natural gas reservoir formations. The phenomena significantly increase the effective heat conductivity of oil and gas reservoirs, and, hence, expand the area of heat action upon the hole-bottom zone of a well. Following the conduction thermoacoustic action upon the hole-bottom zone of a well, there is observed restoration of the oil and gas permeability of the reservoir, affected previously either by deposits of field paraffin and salts, or by ingress of clay into the hole-bottom zone.

There is known a downhole thermoacoustic device (see "Investigation of heat action by deep-hole electric heaters" by E. M. Simkin—a dissertation for Candidate of Technical Sciences degree, 1968, Collections of All-Union Scientific Research Institute of the Ministry of Oil Industry of the USSR), intended for exerting electric heat action upon the hole-bottom zone of an oil or gas well and comprising a heater with a terminal chamber rigidly linked with a radiator or source of acoustic oscillation, including two electromagnets mounted on a common shaft internally of a cylindrical housing. The top electomagnet of the acoustic oscillation radiator is stationary, while the bottom one is movable jointly with the heater along the common shaft. With an electric current flowing, the electromagnets are periodically attracted, although the top electromagnet remains stationary, while the bottom electromagnet and the heater are reciprocated. In this manner there are generated adjustable longitudinal acoustic oscillations of the electric heater in the well, which expands the heated zone.

However, this downhole thermoacoustic device generates oscillation of low intensity which propagate predominantly longitudinally of the borehole, on account of the longitudinal reciprocation of the bottom electromagnet with the heater, whereas the direction of propagation of the oscillation is preferably substantially normal to the axis of the borehole, so as to exert effective thermoacoustic action upon the hole-bottom area.

The known device generates low-frequency oscillation (up to 100 Hz) which fails to create the thermoacoustic effect which is of the threshold character and would take place at a certain range of frequencies.

The device would not enable focusing of the heat field, being devoid of elements capable of controlling the heat variables of the thermoacoustic field.

On account of the incorporation of movable parts and the eventuality of the fluid-tightness of the deivce becoming affected in operation, the performance reliability of the device is inadequate.

With the inter-hole hydraulic static pressure increasing as the device is run down the hole to a predetermined depth, the acoustic parameters of the device are affected by the damping action of the hole fluid.

On account of the longitudinal oscillation of the hole fluid column, some heat is carried upwardly, which affects the temperature conditions of the performance of the electric cable supplying the device and would not enable to exert efficient heat action upon the hole-bottom zone of the well.

Thus, the above described thermoacoustic device for the above discussed reasons would not enable creation of a thermoacoustic field with a high intensity of the acoustic radiation propagating in the radial direction.

SUMMARY OF THE INVENTION

It is an object of the present invention to create a downhole thermoacoustic device providing for enhancing the intensity of the thermoacoustic field propagating in the radial direction.

It is still another object of the present invention to provide for obtaining a focusable acoustic field.

It is a further object of the present invention to create a downhole thermoacoustic device offering an enhanced performance reliability and providing for curbing down the amount of heat propagating toward the electric supply cable.

These and other objects are attained in a downhole thermoacoustic device comprising a radiator of acoustic oscillation and a heater with a terminal chamber, connected with the radiator, wherein, in accordance with the invention, the radiator of acoustic oscillation has a hollow housing with a longitudinal shaft mounted thereinside, supporting successively arranged coils of which the cores include at least one active element intended for generating acoustic oscillation.

It is expedient that in a downhole thermoacoustic device embodying the invention the core of the coil should be hollow, with a reflector of acoustic oscillation accommodate internally of the core on the longitudinal shaft, intended for intensifying the acoustic iscillation in the radial direction.

It is also expedient, in order to enhance the efficiency of thermoacoustic action upon the hole-bottom area of a well, to have the downhole thermoacoustic device including elements for focusing the acoustic field mounted on the longitudinal shaft intermediate the coils, in accordance with the invention.

It is reasonable, in order to protect the heater and the power supply cable against acoustic action, that the downhole thermoacoustic device embodying the invention should include damping elements mounted on the longitudinal shaft in the top and bottom portions of the hollow housing, to damp out the acoustic oscillation.

The downhole thermoacoustic device embodying the invention may include a heat-insulation member accommodated intermediate the terminal chamber of the heater and the radiator of acoustic insulation, intended for withdrawing heat from the radiator of acoustic insulation.

It is expedient that the downhole thermoacoustic device embodying the invention should have the active element of the coil in the form of a flat ring made of a magnetostrictive material.

The downhole thermoacoustic device embodying the invention may alternatively have the active element of the coil in the form of a hollow cylinder of a piezoceramic material.

It is reasonable that the downhole thermoacoustic device embodying the invention should have the active element of the coil made of ferrite possessing magnetostrictive properties.

It is quite reasonable that the thermoacoustic device embodying the invention should have the element for focusing the acoustic field shaped as a sleeve.

It is quite expedient that the downhole thermoacoustic device embodying the invention should have the element for focusing the acoustic field in the form of a sleeve made of a material having damping properties.

It is expedient that the downhole thermoacoustic device embodying the invention should have its damping elements made in the form of sleeves of a resilient material.

To enhance the efficiency of heat withdrawal, it is expedient that the device embodying the invention should have the heat-insulation member in the form of a sleeve with a fluted surface.

The downhole thermoacoustic device embodying the invention may have the internal space of the housing of the radiator of acoustic insulation filled with a heat-resistant compound.

The herein disclosed downhole thermoacoustic device provides for generating acoustic oscillation within a certain range of frequencies, with a high intensity of the acoustic field propagating in the radial direction. Owing to the incroporation of the elements for focusing the acoustic field in the herein disclosed downhole thermoacoustic device, it has become possible to bring into focus the heat field, too.

The herein disclosed downhole thermoacoustic device is devoid of movable parts, which enhances its performance reliability while retaining the acoustic characteristics. The acoustic oscillation produced by this downhole thermoacoustic device propagates predominantly in the radial direction, whereby the temperature conditions of the operation of the power supply cable are maintained at a satisfactory level, and the durability of the cable is enhanced.

BRIEF DESCRIPTION OF DRAWINGS

Other objects and advantages of the present invention will become apparent from the following detail description of an embodiment thereof, with reference being had to the accompanying drawings, wherein.

DESCRIPTION OF THE PREFERRED EMBODIMENT

Figure 1:
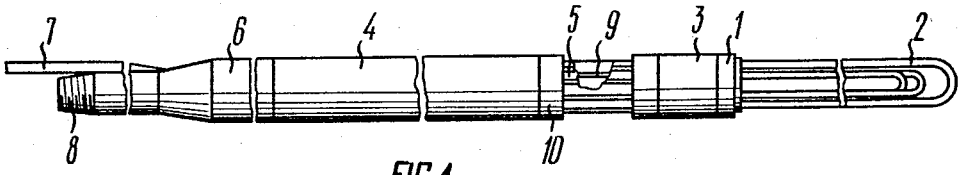
FIG. 1 schematically illustrates a general view of a downhole thermoacoustic device embodying the invention.

FIG. 1 is the appended drawings shows a general view of the downhole thermoacoustic device. The downhole thermoacoustic device in this case comprises a heater 1 with electric heating elements 2. The heater 1 is connected via a fluid-tight terminal chamber 3 with a radiator 4 of acoustic oscillation, with a heat-insulation member 5 accommodated between the radiator 4 of acoustic oscillation and the terminal chamber 3, to withdraw heat from the radiator 4 of acoustic oscillation, so as to protect it against overheating.

The downhole thermoacoustic device further comprises a cable head 6 mounted on one of the ends of the radiator 4 of acoustic oscillation. This cable head 6 is incorporated for establishing fluid-tight connection of the power supply cable 7 with the radiator 4 of acoustic oscillation, and also for attaching the downhole thermoacoustic device to the tubing string (not shown in the drawings) used for running the device into the well. For connection with the string, the cable head 6 is provided at the top portion thereof with a pipe-type taper thread 8. The downhole thermoacoustic device can be adapted to be run into a hole on the cable rope.

Accommodated internally of the heat insulation member 5 are heat-resistant electric conductors 9 for supplying power from a ground source (not shown in FIG. 1) to the electric heater 1. The heat insulation member 5 is shaped as a sleeve electrically and mechanically linked with the radiator 4 of acoustic oscillation with aid of threaded adapter means 10. In the presently described embodiment, the periphery of the heat insulation member 5 is longitudinally ribbed or fluted to enhance the withdrawal of heat.

Figure 2:
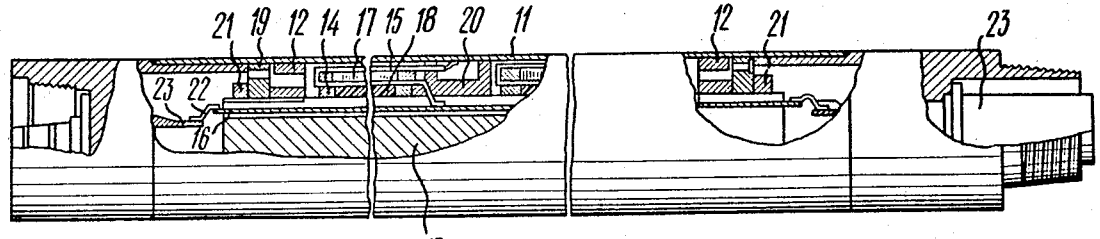
FIG. 2 is a schematic general partly longitudinally sectioned view of the radiator of acoustic oscillation of the downhole thermoacoustic device.

FIG. 2 presents a schematic partly longitudinally sectioned general view of the radiator 4 of acoustic oscillation, including a hollow housing 11 having mounted in washers 12 internally and centrally thereof a longitudinal shaft 13.

The shaft 13 supports thereon an electric coil 14 with winding wire 15.

One end lead of the winding wire 15 is connected to the hollow housing 11, while the other end of the winding wire 15 of each coil is connected to a supply bus 16. The core of each coil 14 is made up of active elements 17 intended for generating acoustic oscillations. In the presently described embodiment each active element 17 is in the form of a flat ring of a magnetostrictive material, e.g. of the "Parmendur" alloy type. Each active element 17 is adapted to generate ultrasonic oscillations propagating predominantly in the radial direction. Accommodate internally of each coil 14 is a reflector 18 of acoustic oscillation which in the presently described embodiment is of a tubular shape, intended for enhancing the acoustic efficiency in the radial direction. Supported on the longitudinal shaft 13 in the bottom and top portions of the hollow housing 11 are damping elements 19 intended to dampen out acoustic oscillation and providing for reliable electric and mechanical linking with, respectively, the stationary heater 1 (FIG. 1) and the upper tubing string (not shown in FIG. 2).

In the presently described preferred embodiment of the downhole thermoacoustic device, the damping element 19 is made in the form of a sleeve of a resilient material, which provides for maintaining the fluid-tightness and mechanical strength in operation of the downhole thermoacoustic device, as a whole.

Mounted on the longitudinal shaft 13 internally of the cylindrical housing 11, intermediate the oils 14 is an element 20 for focusing the acoustic field, providing for varying the width of the directability pattern of the acoustic field, whereby it becomes possible to control the heat parameter of the thermoacoustic field.

In the presently described embodiment the element 20 is sleeve-shaped. To make the damping effect more pronounced, the element 20 may be in the form of a sleeve of a resilient material.

Nuts 21 hold together the components accommodated in the hollow housing 11 into a single compact stack. Electric connection of the radiator 4 of acoustic oscillation and of the heater 1 (FIG. 1) with the power supply cable 7 is established with aid of electric conductors 22 (FIG. 2) through heat-resistant fluid-tight connectors 23. In the embodiment being described, the internal space of the hollow housing 11 of the radiator 4 of acoustic oscillation is filled up with a pressure-injected heat-resistant compound, which enhances the performance reliability of the radiator 4 of acoustic oscillation, and, hence, the reliability of the operation of the entire device under downhole conditions.

It should be pointed out that alternatively each active element 17 can be made in the form of a hollow cylinder of a piezoceramic material or else in the form of sleeves made of ferrite having magnetostrictive properties.

The device operates, as follows.

Electric power coming from a ground ultrasonic generator (not shown in FIGS. 1 and 2) is supplied via the cable 7 (FIG. 1) and electric conductors 22 and connectors 23 to the heater 1 and the coils 14 of the radiator 4 of acoustic oscillation. Acoustic oscillation is generated in the coils 14 owing to the variation of the radial dimensions of the active elements 17 which in the embodiment described are in the form of flat rings of a magnetostrictive material. This variation of the radial dimensions of the active elements 17 takes place under the action of the alternating magnetic field produced by the coils 14. The direction and directability pattern of the acoustic field are controlled by the reflectors 18 and the elements 20 for focusing the acoustic field. The superimposition of the heat field produced by the heater 1 and of the acoustic field produced by the radiator 4 of acoustic oscillation brings about the effect of multiplied increase of the effective heat conductivity of the formation within the hole-bottom zone of the oil or gas well.

What is claimed is:

1. A downhole thermoacoustic device comprising:

a radiator of acoustic oscillation;

a heater with a terminal chamber, connected to said radiator of acoustic oscillation, said radiator of acoustic oscillation including:

a hollow housing;

a longitudinal shaft mounted internally of said hollow housing;

coils successively mounted on said longitudinal shaft;

cores of said coils having at least one active element;

said active element being adapted for generating acoustic oscillation, and said core of said coil being hollow;

a reflector of acoustic oscillation mounted internally of said core on said longitudinal shaft, said reflector of acoustic oscillation being adapted for intensifying the acoustic oscillation in the radial direction.

2. A downhole thermoacoustic device of claim 1, comprising:

at least one element for focusing the acoustic field, mounted internally of said hollow housing on said longitudinal shaft intermediate said coils.

3. A downhole thermoacoustic device of claim 2, wherein said hollow housing has top and bottom portions; and comprises damping elements mounted in said top and bottom portions of said hollow housing.

4. A downhole thermoacoustic device of claim 3, wherein said hollow housing is filled up with a heat-resistant compound.

5. A downhole thermoacoustic device of claim 2, comprising:

a plurality of said active elements of said cores of said coils;

said active elements including flat rings of a magnetostrictive material.

6. A downhole thermoacoustic device of claim 2, wherein said reflector of acoustic oscillation is shaped as a sleeve.

7. A downhole thermoacoustic device of claim 2, wherein said element for focusing acoustic oscillation is in the form of a sleeve.

8. A downhole thermoacoustic device of claim 7, comprising:

said hollow housing being filled up with a heat-resistant compound.

9. A downhole thermoacoustic device of claim 1, comprising:

top and bottom portions of said hollow housing;

damping elements mounted on said longitudinal shaft in said bottom and top portions of said hollow housing;

said damping elements being adapted for damping said acoustic oscillation.

10. A downhole thermoacoustic device of claim 9, wherein said damping elements includes sleeves of a resilient material.

11. A downhole thermoacoustic device of claim 10, said hollow housing is filled up with a heat-resistant compound.

12. A downhole thermoacoustic device of claim 9, wherein said reflector of acoustic oscillation is in the form of a tube.

13. A downhole thermoacoustic device of claim 9, wherein said coils each have a core including one active element:

said active element of each core including a cylinder of a piezoceramic material.

14. A downhole thermoacoustic device of claim 1, comprising:

a heat-insulation means accommodated intermediate said radiator of acoustic oscillation and said terminal chamber of said heater;

said heat-insulation means being intended for withdrawing heat from said radiator of acoustic oscillation.

15. A downhole thermoacoustic device of claim 4, wherein said coils have cores of active elements;

each said active element being made of ferrite having magnetostrictive properties.

16. A downhole thermoacoustic device of claim 14, wherein said reflector of acoustic oscillation is shaped as a tube.

17. A downhole thermoacoustic device of claim 14, wherein said heat-insulation means includes a sleeve with a fluted surface.

18. A downhole thermoacoustic device of claim 17, wherein said hollow housing being filled up with a heat-resistant compound.

19. A downhole thermoacoustic device of claim 1, comprising:

a plurality of said active elements of said cores of said coils;

said active elements being made in the form of cylinders of a piezoceramic material.

20. A downhole thermoacoustic device comprising:

a radiator of acoustic oscillation;

a heater with a terminal chamber, connected to said radiator of acoustic oscillation, said radiator of acoustic oscillation including:

a hollow housing;

a longitudinal shaft mounted internally of said hollow housing;

coils successively mounted on said longitudinal shaft;

cores of said coils having at least one active element;

said active element being adapted for generating acoustic oscillation, at least one element for focusing the acoustic field, mounted internally of said hollow housing on said longitudinal shaft intermediate said coils.

21. A downhole thermoacoustic device of claim 20, wherein said hollow housing of said radiator of acoustic oscillation has top and bottom portions; further comprising;

damping elements mounted in said top and bottom portions of said hollow housing;

said damping elements being adapted for damping acoustic oscillation.

22. A downhole thermoacoustic device of claim 21, wherein said coils have cores of active elements;

said active element being in the form of flat rings of a magnetostrictive material.

23. A downhole thermoacoustic device of claim 21, wherein said damping elements include sleeves of a resilient material.

24. A downhole thermoacoustic device of claim 21, wherein said active element of said coil is in the form of a cylinder of a piezoceramic material;

said damping elements including sleeves of a resilient material; and said hollow housing of said radiator of acoustic oscillation being filled up with a heat-resistant compound.

25. A downhole thermoacoustic device of claim 20, comprising:

heat-insulation means accommodated intermediate said radiator of acoustic oscillation and said terminal chamber of said heater;

said heat-insulation means being adapted for withdrawing heat from said radiator of acoustic oscillation.

26. A downhole thermoacoustic device of claim 25, said active element of each said coil is in the form of a flat ring of a magnetostrictive material;

said element for focusing the acoustic field is in the form of a sleeve; and said heat-insulation means includes a sleeve with a fluted surface.

27. A downhole thermoacoustic device comprising:

a radiator of acoustic oscillation;

a heater with a terminal chamber, connected to said radiator of acoustic oscillation, said radiator of acoustic oscillation including:

a hollow housing;

a longitudinal shaft mounted internally of said hollow housing;

coils successively mounted on said longitudinal shaft;

cores of said coils having at least one active element;

said active element being adapted for generating acoustic oscillation, said hollow housing having the top and bottom portions; damping elements mounted on said longitudinal shaft in said top and bottom portions of said hollow housing, said damping elements adapted for damping the acoustic oscillation, said core of said coil being hollow;

a reflector of acoustic oscillation adapted for intensifying the acoustic oscillation in the radial direction;

at least one element for focusing acoustic oscillation, mounted internally of said hollow housing on said longitudinal shaft intermediate said coils;

said hollow housing having a top portion and a bottom portion.

28. A downhole thermoacoustic device comprising:

a radiator of acoustic oscillation;

a heater with a terminal chamber, connected to said radiator of acoustic oscillation, said radiator of acoustic oscillation including:

a hollow housing;

a longitudinal shaft mounted internally of said hollow housing;

coils successively mounted on said longitudinal shaft;

cores of said coils having at least one active element;

said active element being adapted for generating acoustic oscillation;

heat-insulation means accommodated intermediate said radiator of acoustic oscillation and said terminal chamber of said heater; said heat-insulation means being adapted for withdrawing heat from said radiator of acoustic oscillation, said core of said coil, being hollow;

a reflector of acoustic oscillation, adapted for intensifying the acoustic oscillation in the radial direction; and at least one element for focusing the acoustic oscillation, mounted internally of said hollow housing on said longitudinal shaft intermediate said coils.

29. A downhole thermoacoustic device of claim 28, comprising: a top and bottom portions of said hollow housing;

damping elements mounted on said longitudinal shaft in said top and bottom portions of said hollow housing;

said damping elements being intended for damping said acoustic oscillations.

30. A downhole thermoacoustic device of claim 29 comprising:

said damping elements made in the form of sleeves of a resilient material.

31. A downhole thermoacoustic device of claim 29 comprising:

a heat insulating element received between said radiator of acoustic oscillations and said terminal chamber of said heater;

said heat insulating element being intended for withdrawing heat from said radiator of acoustic oscillations;

said heat insulating element being made in the form of a sleeve having a fluted surface.

32. A downhole thermoacoustic device of claim 31, comprising:

a space of said hollow housing, filled with a heat resistant compound; said heat resistant compound being intended for raising the electrical and mechanical strength of said acoustic radiator.

33. A downhole thermoacoustic device of claim 32, comprising:

a plurality of said active elements of said cores of said coils;

said reflectors of acoustic oscillations made in the form of tubes;

a plurality of said elements for focusing the acoustic field, mounted internally of said hollow housing of said radiator of acoustic oscillations on the longitudinal shaft between each pair of said coils;

said elements for focusing the acoustic field being made in the form of sleeves;

said damping elements being made in the form of sleeves of a resilient material.

34. A downhole thermoacoustic device of claim 33, comprising:

said active elements made in the form of flat rings of a magnetostrictive material.

35. A downhole thermoacoustic device of claim 33, comprising:

said active elements made in the form of cylinders of a piezoceramic material.

36. A downhole thermoacoustic device of claim 33, comprising:

said active elements made of ferrite having magnetostrictive properties.

37. A downhole thermoacoustic device comprising:

a radiator of acoustic oscillation;

a heater with a terminal chamber connected to said radiator of acoustic oscillations;

said radiator of acoustic oscillations including:

a hollow housing;

a longitudinal shaft mounted internally of said hollow housing coils successively mounted on said longitudinal shaft;

cores of said coils having at least one active element each;

said active element being adapted to generate acoustic oscillations;

said core of said coil being hollow; reflectors of acoustic oscillations mounted internally of each of said cores on said longitudinal shaft;

said reflectors of acoustic oscillations being adapted to intensify the acoustic oscillations in the radial direction away from the axis of said radiator of acoustic oscillations.

* * * * *